US007683844B2

(12) United States Patent
Alamouti et al.

(10) Patent No.: US 7,683,844 B2
(45) Date of Patent: Mar. 23, 2010

(54) MM-WAVE SCANNING ANTENNA

(75) Inventors: Siavash Alamouti, Hillsboro, OR (US); Alexander A. Maltsev, Nizhny Novgorod (RU); Nikolav Chistyakov, Nizhny Novgorod (RU); Alexey Artemenko, Nizhny Novgorod (RU)

(73) Assignee: Intel Corporation, Santa Clara, CA (US)

( * ) Notice: Subject to any disclaimer, the term of this patent is extended or adjusted under 35 U.S.C. 154(b) by 288 days.

(21) Appl. No.: 11/803,918

(22) Filed: May 16, 2007

(65) Prior Publication Data

US 2008/0284655 A1 Nov. 20, 2008

(51) Int. Cl.
*H01Q 19/06* (2006.01)

(52) U.S. Cl. ..... 343/754; 343/853; 343/876

(58) Field of Classification Search ..... 343/700 MS, 343/876, 853, 754
See application file for complete search history.

(56) References Cited

U.S. PATENT DOCUMENTS 5,554,865 A * 9/1996 Larson ..... 257/275
5,710,430 A * 1/1998 Nuss ..... 250/358.1
7,012,573 B2 3/2006 Tchistiakov et al.
7,088,964 B2 8/2006 Kyongyop

OTHER PUBLICATIONS

Babakhani, Aydin, et al., "A 77-GHz Phased-Array Transceiver With On-Chip Antennas in Silicon: Receiver and Antennas", *IEEE Journal of Solid-State Circuits*, vol. 41, No. 12, (Dec. 2006), pp. 2795-2806.
Filipovic, Daniel F., et al., "Off-Axis Properties of Silicon and Quartz Dielectric Lens Antennas", *IEEE Transactions on Antennas and Propagation*, vol. 45, No. 5, (May 1997), pp. 760-766.
Hieda, Morishige , et al., "High-Isolation Series-Shunt FET SPDT Switch With a Capacitor Canceling FET Parasitic Inductance", *IEEE Transactions on Microwave Theory and Techniques*, vol. 49, No. 12, (Dec. 2001), pp. 2453-2458.
Krems, T., et al., "Millimeter-Wave Performance of Chip Interconnections Using Wire Bonding and Flip Chip", *1996 IEEE MTT-S Digest*, (1996), pp. 247-250.
Masanobu, Kominami , et al., "Dipole and Slot Elements and Arrays on Semi-Infinite Substrates", *IEEE Transactions on Antennas and Propagation*, vol. AP-33, No. 6, (Jun. 1985), pp. 600-607.
Mizutani, Hiroshi , et al., "DC-110-GHz MMIC Traveling-Wave Switch", *IEEE Transactions on Microwave Theory and Techniques*, vol. 48, No. 5, (May 2000), pp. 840-845.

* cited by examiner

*Primary Examiner*—Tho G Phan
(74) *Attorney, Agent, or Firm*—Ryder, Lu, Mazzeo and Konieczny, LLC; Douglas J. Ryder

(57) ABSTRACT

In general, in one aspect, the disclosure describes a semiconductor antenna having a plurality of antenna elements and a switching network formed in the same semiconductor die. The switching network is to control activation of the antenna elements.

12 Claims, 5 Drawing Sheets

MM-WAVE SCANNING ANTENNA

BACKGROUND

Wireless communication systems enable users to communicate remotely via radio frequencies (RF). Current wireless communication systems such as wireless local area networks (WLAN) and wireless personal area networks (WPAN) may utilize mm-wave communications. Wireless devices utilize antennae to receive data and radios to generate the RF signals to transmit data.

FIG. 1 illustrates an example receiving scanning antenna 100 utilized in imaging systems. The antenna 100 includes a lens 110 and antenna elements 120. The lens 110 includes a hemispherical portion 112 having a radius R and a cylindrical extension 114 having a length L. The lens 110 may be fabricated from dielectric material. The antenna elements 120 are placed on a flat surface of the cylindrical extension 114. Each antenna element 120 receives signals by its own beam 130. The direction of a beam 130 is based on displacement X of a corresponding antenna element 120 from a focal point 116 of the lens 110. Beam-scanning can be accomplished by switching the antenna elements 120 which may require external switching circuitry and is complex at mm-wave frequencies. Alternatively, external circuitry may be utilized to pass video signals out of each antenna element 120 in order to accomplish beam scanning. The antenna 100 can operate in receive mode but cannot operate in transmit mode. Accordingly, the antenna 100 can not be used with communication transceivers.

BRIEF DESCRIPTION OF THE DRAWINGS

The features and advantages of the various embodiments will become apparent from the following detailed description in which.

DETAILED DESCRIPTION

Antennae elements utilized in a scanning antenna may be fabricated in a semiconductor chip (e.g., on the surface of the chip). The semiconductor chip may be fabricated using a highly-resistive semiconductor material (e.g., GaAs). Various types of antenna elements may be formed in the semiconductor chip including, but not limited to, printed dipoles fed by microstrip lines where U-baluns over ground are used for phase splitting, printed bow-tie monopoles fed by microstrip lines or coplanar waveguides (CPW), and slots fed by CPWs.

The semiconductor chip may include a plurality of antenna elements on the same chip. The antennae elements may be aligned in various configurations (e.g., horizontally, vertically, in a two dimensional (2D) array). Providing a 2D array enables the semiconductor antenna to provide beams in two directions. The antenna elements on the chip may be utilized for transmitting, receiving, or transceiving (if a transmit/receive switch is used). Some antenna elements may be used for receiving and others may be used for transmitting which would eliminate the need for the transmit/receive switch but would require the semiconductor chip to have two separate RF interconnections (one for the transmitters and one for the receivers). The usage of two RF interconnections though possible is not desired. A single RF interconnection with the RX/TX switch is more reliable.

Linear sizes of the antenna elements may be close to half the wavelength ($\lambda/2$) in the dielectric of the lens that the antenna will be connected to and used in conjunction with (discussed in more detail later). The element to element spacing may also be close to $\lambda/2$ for packing efficiency.

Figure 1:
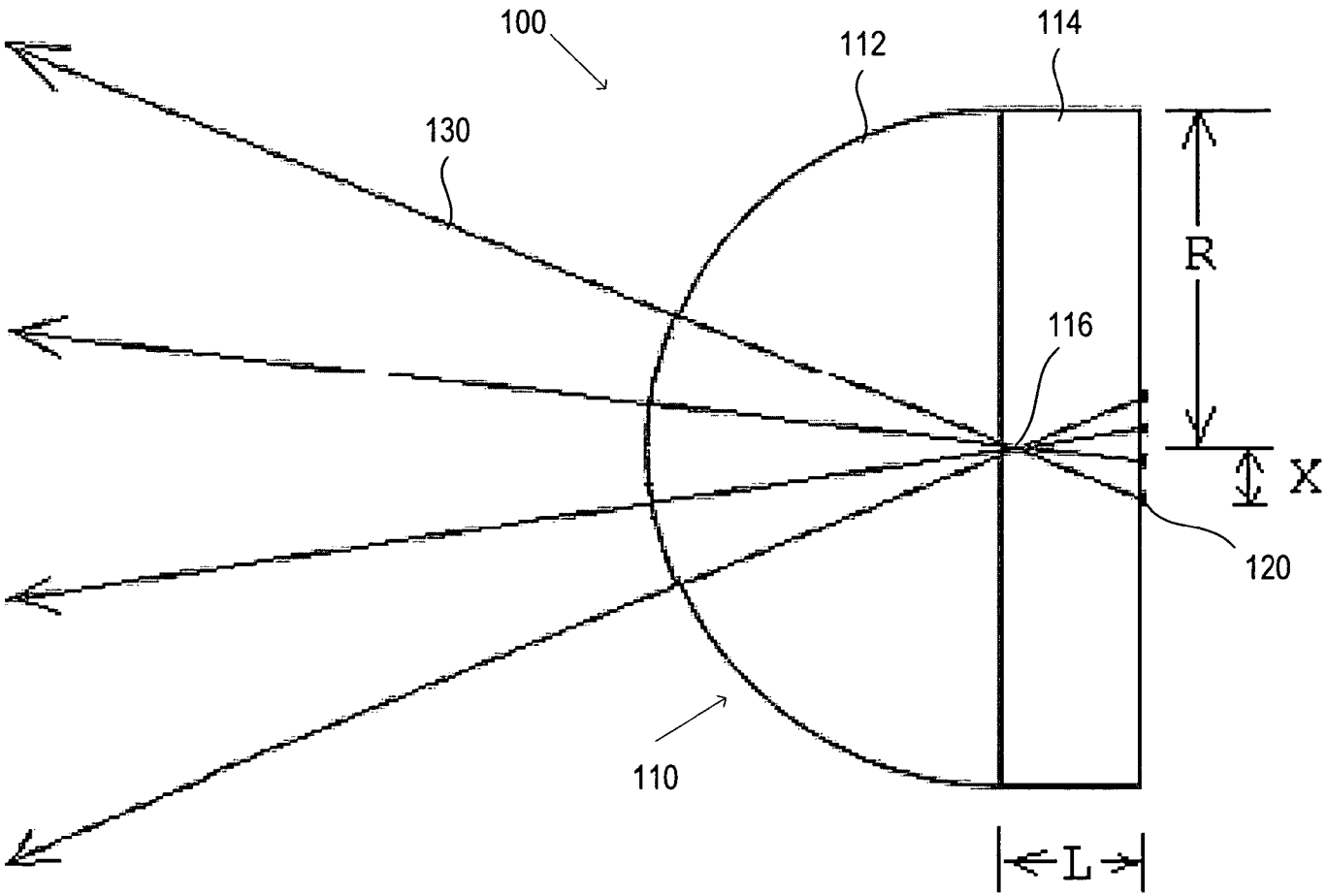
FIG. 1 (PRIOR ART)
FIG. 1 illustrates an example receiving scanning antenna utilized in imaging systems, according to one embodiment.
Figure 2A:
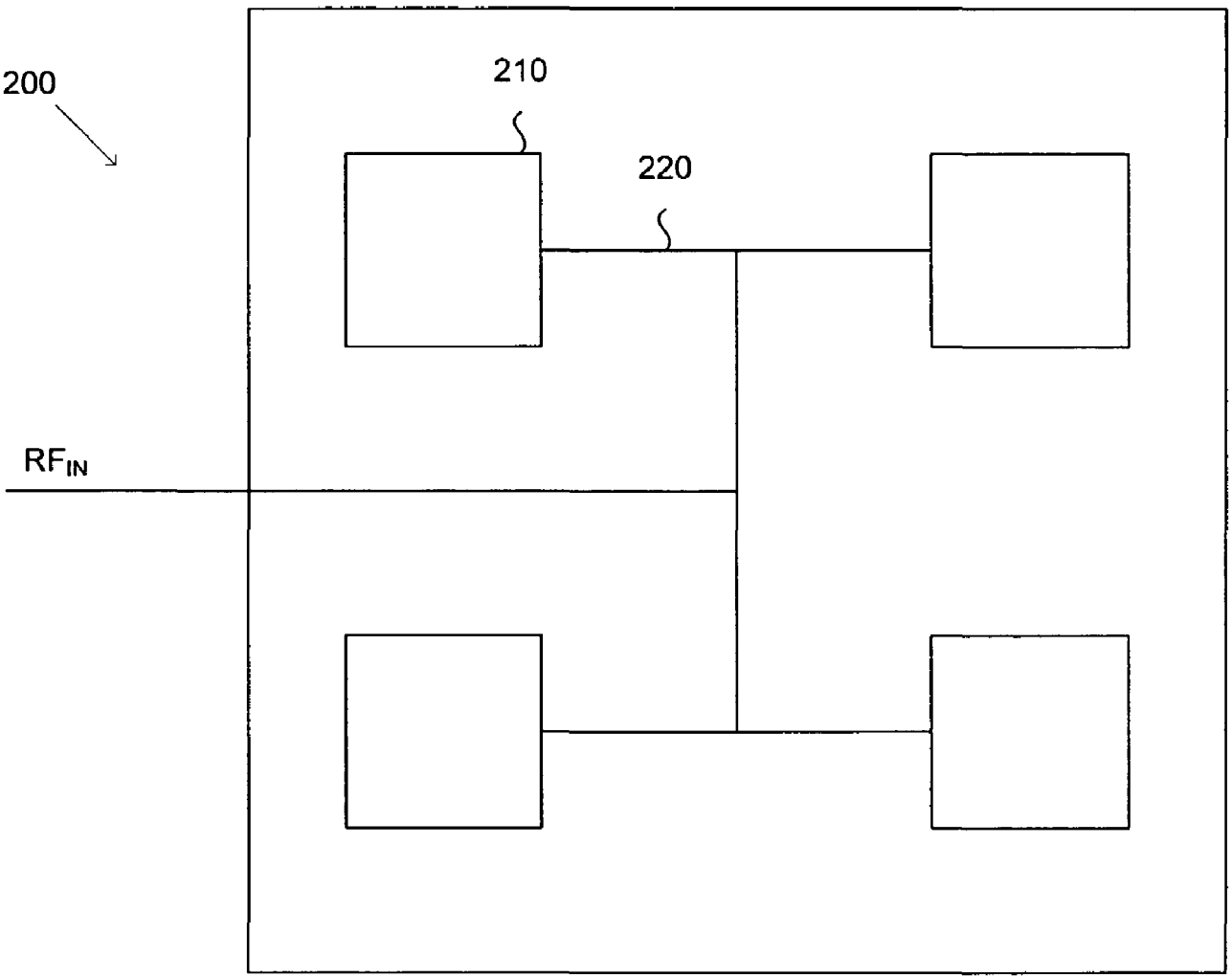
FIGS. 2A-C illustrate an example semiconductor antenna, according to one embodiment.

FIG. 2A illustrates an example semiconductor antenna 200. The antenna 200 includes 4 antenna elements 210 arranged in a 2×2 array. The antenna elements 210 are connected to an RF input (RFin) and each other via transmission lines 220 (RF communications tree). Wave impedances of each of the transmission lines 220 can be equal (or substantially equal) to each other and can be equal to input impedance (Zo) of the antenna elements 210 for power equality. Alternatively wave impedances of the lines can be different from Zo and used for impedance transformation, for better matching with RFin. The path length of the transmission lines 220 may also be the same (or substantially the same).

The semiconductor chip may also include a switching network to control the activation of the various antenna elements on the semiconductor die. The switching network may include a plurality of switches (e.g., field effect transistors (FETs), Radio Frequency Micro-Electro-Mechanical Systems (RF-MEMS)). The switches may be implemented as a single FET in a shunt configuration with its drain connected to the signal path (RFin) and its source connected to ground. A control signal applied to the gate can either open or close the channel of the FET. When the channel is opened its conductivity is high and the signal path is shorted stopping the mm-wave signal. When the channel is closed its conductivity is low and the mm-wave signal passes. FET switches do not consume power in steady state and consume negligibly small power in switching during the transient. Controlling the switching of the antenna elements can enable beam scanning when the semiconductor chip is utilized in conjunction with a lens.

Figure 2B:
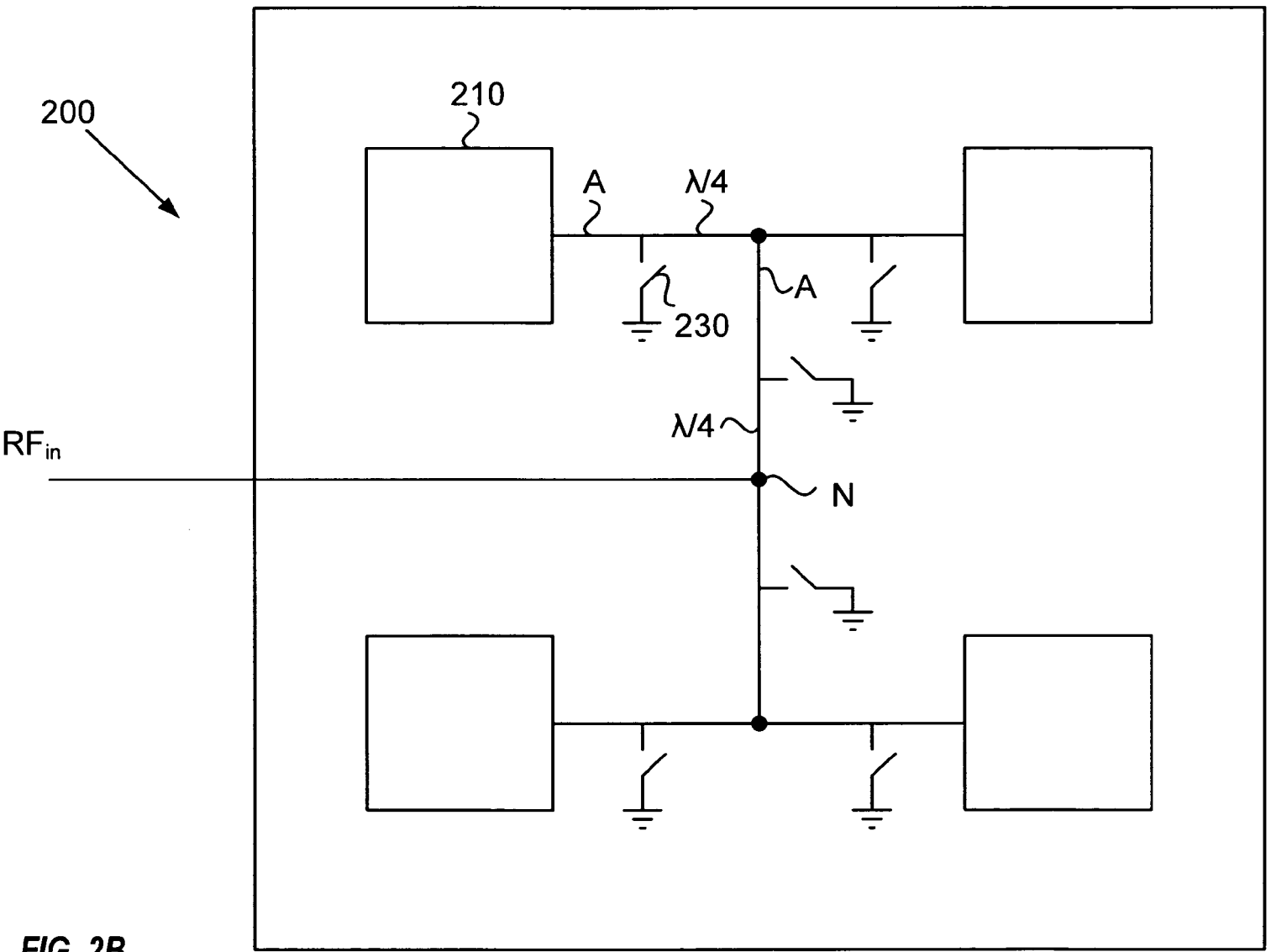

FIG. 2B illustrates the example semiconductor antenna 200 having a switching network to control the mm-wave signals being received or transmitted by the antenna elements 210. The switching network includes a switch 230 incorporated in the transmission lines for each branch of the RF communications tree. Accordingly there are two switches 230 in the path to each antenna element 210. In order for a particular antenna element 210 to receive/transmit the mm-wave signals the two switches in the path must be closed. This switching network may provide constant path-lengths and number of passed switches for activating any antenna element in the array. This provides equality of received/transmitted power for each antenna element 210 in the network. The use of multiple switches 230 in the transmission path to an antennae element 210 allows better isolation and limits the leakage from RFin to non-activated antenna elements through the closed switches.

The transmission line feeding each switch 230 (single FET transistor in shunt configuration) may have an electrical length that is an odd integer multiple of $\lambda/4$. If the FET is in an ON (the switch is in an OFF) state it has a small resistive load (e.g., 4-8 ohms) and the $\lambda/4$-line may transform the small resistive load into high resistance (e.g. 313-625 ohms). The high resistive load acts as an open switch isolating antenna elements downstream from the switch 230. The transmission line connected to the other side of the switch may have an arbitrary length (A). The nodes (N) connected to the $\lambda/4$-lines see the input impedance from the $\lambda/4$-line, which is either infinite (when the switch is closed) or Zo (when the switch is open). It should be noted that provided only one antenna element 210 in the array is activated the array input impedance is substantially constant, regardless which specific antenna element is activated, and can be close to Zo.

It should be noted that switches 230 need not be included for each transmission branch. Rather, any branch containing a switch that is not directly connected to an antenna element 210 can be removed and replaced with a branch that has an electrical length that is a multiple of λ/2. The λ/2-line does not transform the load so the node will still see either infinite or Zo impedance depending on the downstream switches.

Figure 2C:
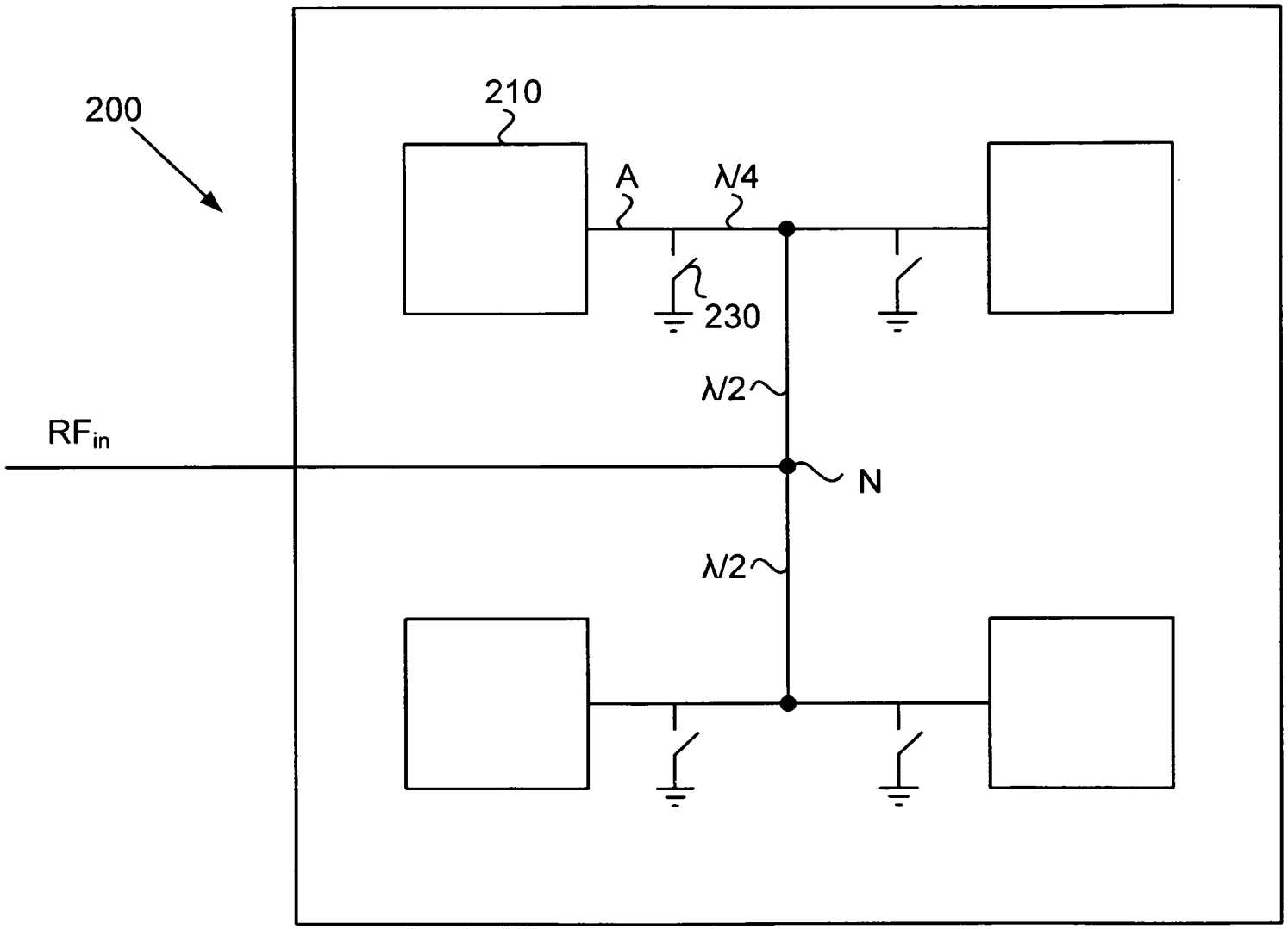

FIG. 2C illustrates the example semiconductor antenna 200 with certain switches 230 removed and the transmission lines replaced with λ/2-lines. As illustrated the only switch 230 controlling the operation of the antenna elements 210 is the switch 230 directly connected to the antenna element 210. Accordingly, this implementation may be susceptible to leakage. While not illustrated, the λ/2-lines connecting fixed points may require bends (e.g., wave-like bendings along the lines). The lines of arbitrary length may be straight lines.

While not illustrated in either FIG. 2B-C, the semiconductor antenna 200 may include pads (or other interconnects) for receiving control signals from external circuitry and conductors from the pads to the switches 230 to provide the control signals to the appropriate switches.

The selection of the appropriate number of switches 230 is a design parameter. The more switches that are utilized the less impact leakage in any one switch will have on the operation. However, the more switches the more complex the circuitry is as additional FETs (or RF-MEMS) need to be formed in the semiconductor and conductors need to be laid out to provide control signals thereto. Utilizing too many switches may result in layout issues. Reducing the number of switches simplifies the circuit but reduces the flexible of the design layout due to the required bends in the transmission lines. In addition discontinuities may be introduced in the bends in the λ/2 transmission lines.

Figure 3:
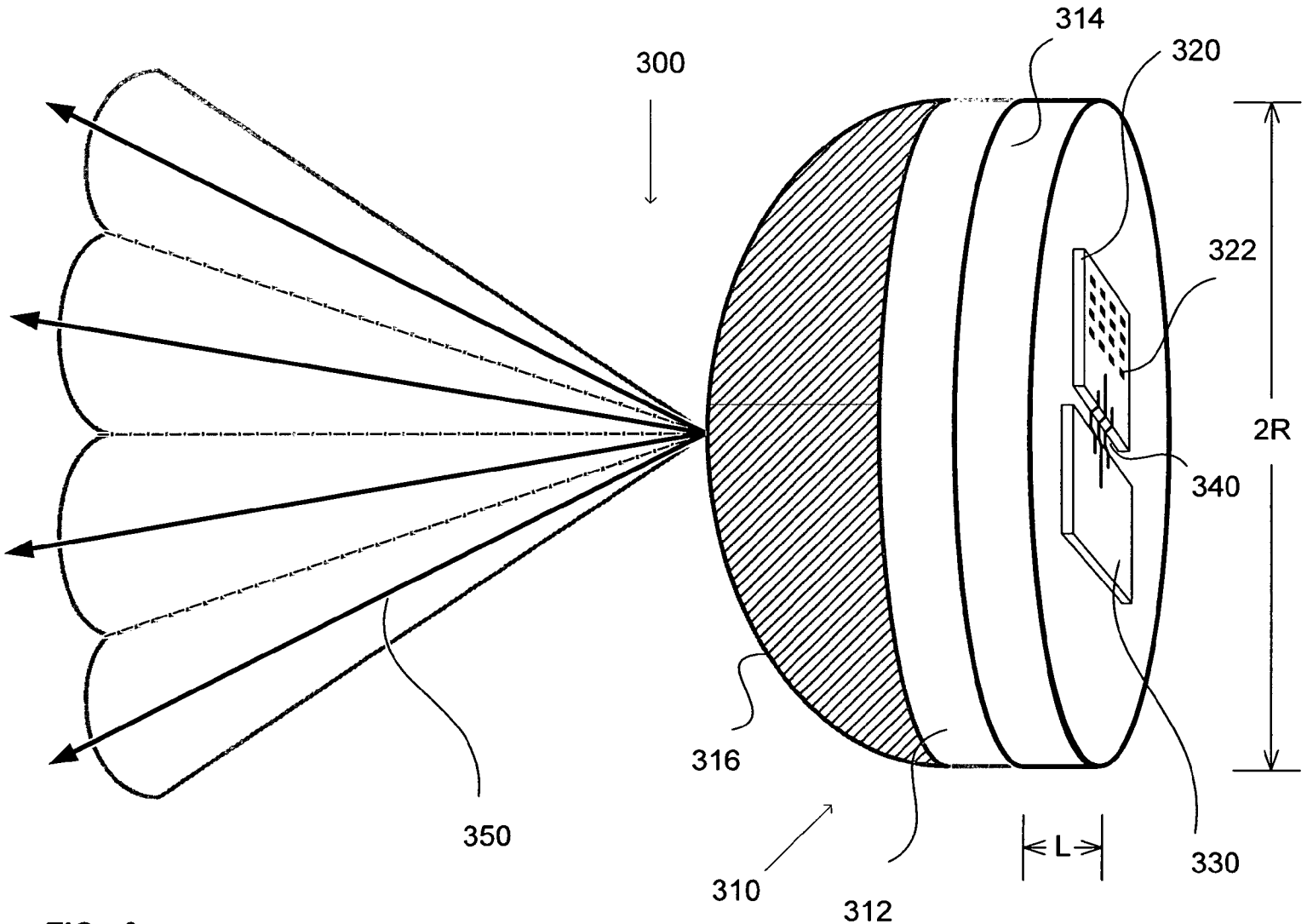
FIG. 3 illustrates an example antenna system, according to one embodiment.

FIG. 3 illustrates an example antenna system 300. The antenna system 300 includes a dielectric lens 310 and a semiconductor chip-antenna 320 (e.g., 200 of FIGS. 2B-C). The antenna system 300 may also include an on-chip radio 330. The lens 310 includes a hemispherical portion 312 having a radius R and a cylindrical extension 314 having a length L. The lens 310 may be fabricated from silicon (Si) or other low loss material with high dielectric constant. To reduce reflections at the lens to air interface, an anti-reflective cap 316 may be used. The dielectric constant of the cap 316 may be intermediate between that of the lens and air.

The R and the L/R ratio determine the antenna gain, and the L/R also influences the gain constancy in scanning. The parameters R and L can be selected depending on the type of lens desired (e.g., approximate an elliptic lens for ray focusing and high gain, provide diverging rays allowing broader beam-width). For use in a mm-wave communication system (e.g., WLAN, WPAN) the size of the lens is selected to meet the requirements for: sufficiently high gain and gain constancy in scanning; ability to scan in sufficiently wide range of angles; compatibility with the sizes of the chip-antenna; and beams overlapping in scanning (e.g. at 3 dB level) for preventing dead zones.

The chip-antenna 320 includes antenna elements 322 and a switching network (not illustrated) integrated on the same chip. The chip-antenna 320 is placed onto the flat surface of the lens 310 (the cylindrical extension 314) with the antenna elements 322 looking into the air. The element to element spacing normalized to the lens radius ΔX/R and the dielectric constant of the lens determine the angle difference between the axes of neighboring beams 350. The switching network enables the antenna elements to be switched for beam scanning without the need for external interconnects between the antenna elements 322 and the switches. Control signals utilized to operate the switches may be received via external circuitry (not illustrated). To achieve scanning, the control signals are applied to associated switches in order to turn the antenna elements ON one by one.

The chip-antenna 320 may include pads (not illustrated) for receiving the control signals and thin conductors (not illustrated) for conveying the control signals to the switches. A simple wire bonding interconnection (low frequency) may be used to transmit the control signals to the chip-antenna 320 since the signals are not critical and interconnection losses may be tolerated. Furthermore, the wire bonding interconnections should not create any issues.

As noted above, the semiconductor material used to fabricate the chip-antenna 320 must be highly resistive (e.g., GaAs) for loss minimization in the semiconductor substrate supporting the antenna elements. However, the high-resistivity of the semiconductor limits the possibility of fabricating the circuits of a radio on the same chip. Accordingly, the on-chip radio 330 may be fabricated on an individual low resistivity chip (e.g., on silicon with bulk resistivity of 20 Ω·cm or less).

The separation of the antenna elements from analog and digital circuits of the radio relaxes interference issues. In addition, when antenna elements are densely packed and occupy a large area on the semiconductor (e.g. 2D-array) the exclusion of the radio from the semiconductor can be cost effective. Additionally, using an advanced silicon technology a stand-alone radio may be fabricated at low price.

However, the interconnections of chips create issues at mm-waves including additional losses and cost increases. However, the antenna system 300 may employ a single RF interconnection 340 for transmitting mm-wave signals between the chip antenna 320 and the on-chip radio 330. The RF interconnection 340 may be a single flip-chip interconnection. Such an interconnection may have limited loss (e.g., 0.5 dB or less) attributed thereto. The chip antenna 320 and the on-chip radio 330 contain RF pads (e.g. ground-signal-ground) for communicating via the RF interconnection 340.

The chip-antenna 320 may have a dielectric constant that is close to dielectric constant of the lens 310 that it is mounted to. The lens 310 can be treated as semi-infinite space filled with dielectric because the lens 310 eliminates surface waves; the antenna elements 322 will not "sense" the presence of the lens boundaries as reflections are suppressed by the anti-reflection cap 316; and the lens 310 is large compared to the size of an antenna element 322 and λ. Losses in the lens material and in the bulk of the semiconductor are small, because of lossless dielectric and high-resistivity semiconductor material utilized. Therefore, the antenna elements will efficiently radiate power into the lens, and further through the curved surface of the lens into the outer space. It should be noted that ratio of powers radiated by the chip-antenna 320 into the lens 310 and into air is $\in^{3/2}$ and, for example, for a lens made of silicon $\in \sim 11$, power radiated into air is negligible.

The chip-antenna 320 and/or on-chip radio 330 placed on the lens 310 will produce a step(s) equal to the thickness of the chips. To eliminate the step(s), and make the chip-antenna flush with the lens surface, undoped semiconductor slabs as thick as the chip(s) may also be placed on the lens near the chip-antenna 320 and/or on-chip radio 330.

The antenna system 300 described above can be utilized in wireless communications systems (e.g., WLAN, WPAN). The antenna system 300 may be included in portable devices (e.g., laptops, cell phones) or may be included in stationary devices (e.g., base stations). The antenna system 300 incorporated in portable devices will be limited in size and accordingly the size of the lens 310 as well as the number of antenna elements 322 formed in the semiconductor antenna 320 are limited. For base station applications where the size is not as restricted the parameters can be increased.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed:

1. A semiconductor scanning beam antenna comprising a plurality of antenna elements formed in a semiconductor;

an RF interconnect formed in the semiconductor;

an RF communications tree, formed in the semiconductor, to provide a signal path between the RF interconnect and the plurality of antenna elements; and a switching network, formed in the RF communications tree, to control activation of the plurality of antenna elements, wherein the switching network is to switch which of the plurality of antenna elements is connected to the RF interconnect responsive to control signals, and wherein switching the antenna element that are connected to the RF interconnect is to provide beam scanning.

2. The antenna of claim 1, wherein the switching network includes at least one switch associated with each antenna element.

3. The antenna of claim 1, wherein the switching network includes a switch for each branch of the RF communications tree.

4. The antenna of claim 1, further comprising pads to receive the control signals from external circuitry and conductors to provide the control signals to the switching network.

5. The antenna of claim 1, wherein the RF interconnect is a pad.

6. The antenna of claim 1, wherein the semiconductor is a highly resistive material.

7. The antenna of claim 1, wherein the semiconductor is GaAs.

8. The antenna of claim 1, wherein the switching network includes a plurality of field effect transistors utilized as switches.

9. The antenna of claim 1, wherein the switching network includes a plurality of Radio Frequency Micro-Electro-Mechanical Systems utilized as switches.

10. The antenna of claim 1, wherein the antenna is installed on an extended hemispherical lens fabricated from high-permittivity dielectric.

11. The antenna of claim 10, wherein the antenna is to communicate with an on-chip radio also installed on the extended hemispherical lens.

12. The antenna of claim 11, wherein the antenna is to communicate with the on-chip radio via a single external RF interconnection also installed on the extended hemispherical lens.

* * * * *